United States Patent [19]

Soo

[11] Patent Number: 4,744,574

[45] Date of Patent: May 17, 1988

[54] BLADE FOR HOCKEY SKATES

[76] Inventor: Mike Soo, No. 403, Chung Shan Road, Jen Teh Hsiang, Tainan Hsien, Taiwan

[21] Appl. No.: 70,166

[22] Filed: Jul. 1, 1987

Related U.S. Application Data

[63] Continuation-in-part of Ser. No. 873,531, Jun. 12, 1986, abandoned.

[51] Int. Cl.[4] ..... A63C 1/30

[52] U.S. Cl. ..... 280/11.18; 280/11.12

[58] Field of Search ..... 280/11.18, 11.12

[56] References Cited

U.S. PATENT DOCUMENTS 3,212,786 10/1965 Florjancic et al. ..... 280/11.12

FOREIGN PATENT DOCUMENTS 687895 2/1940 Fed. Rep. of Germany ... 280/11.18

3326154 6/1984 Fed. Rep. of Germany ... 280/11.12

*Primary Examiner*—David M. Mitchell

*Attorney, Agent, or Firm*—Poms, Smith, Lande & Rose

[57] ABSTRACT

A blade for ice hockey skates comprising a plurality of slanted slots which are symmetrically provided on the top edge of the blade. Each opening of the slots faces upward and toward the center line of the blade. Each of remaining materials between two adjacent slanted slots, and between either of the ends of the blade and the slanted slot adjacent to the end is bent alternately leftward and rightward about a non-horizontal axis on the remaining material so as to create end surfaces that can be viewed from either end of the blade.

3 Claims, 5 Drawing Sheets

BLADE FOR HOCKEY SKATES

CROSS REFERENCE OF THE INVENTION

This application is a continuation-in-part application of Ser. No. 873,531, filed June 12, 1986, now abandoned.

BACKGROUND OF THE INVENTION

This invention relates to a blade for ice skates, particularly to a blade having a plurality of alternately facing oblique triangular surfaces on the top edge thereof.

Most skates comprise a shoe portion for containing a skater's foot and a base portion attached to the lower surface of the shoe portion for sliding on ice. The base portion further comprises a blade whose lower edge is supposed to slide on the ice, and a plastic material jointed to the upper part of the blade. Since attachability of plastic material to the upper part of the blade is not high due to the plane contact surface therebetween, the plastic material is inherently subject to detachment from the blade. In order to mitigate the easy detachment problem, DE Pat. No. 3,326,154 to Tessari disclosed a steel blade whose upper edge is provided with cut-outs having either the same direction or the opposite direction on the two sides of the center line. Then, shrinkable plastics are applied by injection molding on the upper part of the blade. This ensures a high strength of the joint between plastics and metal blade. For the same purposes, U.S. Pat. No. 3,212,786 to Florjancic et al disclosed that the blade is provided with a plurality of elongated indentations evenly spaced in the longitudinal direction of the blade alternatively from opposite side faces into the blade so as to form opposite indentation an elongated transverse projection. During molding of the frame means onto the blade, the indentations are completely filled and the lateral projections completely embedded in the plastic material of the frame means. The indentations and projections enhance the jointability between the blade and the frame means. Nevertheless, although these techniques have solved the detachment problem, they introduce new problems. Referring to FIG. 5, a sectional view taken along the inclined slot or cut-out of Tessari, it can be seen that the multiplicity of areas A are the only areas on which normal stress is applied by the contacting plastic material as the skate is accelerated or decelerated. Therefore, the contacting plastic material is subject to deformation as applied on reactive stress. This disenhances the jointability between the blade and the plastic frame, and thus the portion of plastic material in contact with the side faces of the blade is subject to dislocation. Referring to FIG. 6, a sectional view taken from a vertical plane to the blade of Florjancic et al., it can be seen that areas B have normal stress applied thereto. Since area B is not large enough, the same result of dislocation will occur with the skate disclosed in Florjancic et al. Furthermore, the indentations comparatively complicate the manufacture.

SUMMARY OF THE INVENTION

A primary objective of this invention is therefore to provide a blade which mitigates and/or obviates the drawbacks of the prior art.

Another objective of this invention is to provide a blade which not only is easy to manufacture, but has a satisfactory jointability with the plastic material molded together but also is not easily subject to dislocation with the plastic frame.

Still another objective of this invention is to provide a blade on top edge thereof a plurality of slanted slots are provided. A plurality of oblique triangles are also formed on the remaining material of the blade beside the slot near the center of the blade so as to increase the end surfaces on which normal stress is applied.

Other objectives and advantages of this invention will become apparent from the detailed description presented hereinafter when read in connection with the accompanying drawings.

DETAILED DESCRIPTION OF THE PREFERRED EMBODIMENT

Figure 1:
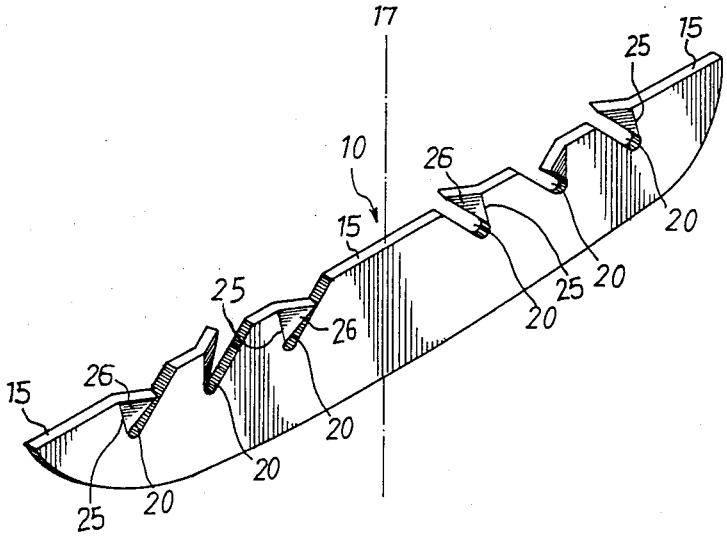
FIG. 1 is a perspective view of the first embodiment of the blade according to the invention.
Figure 2:
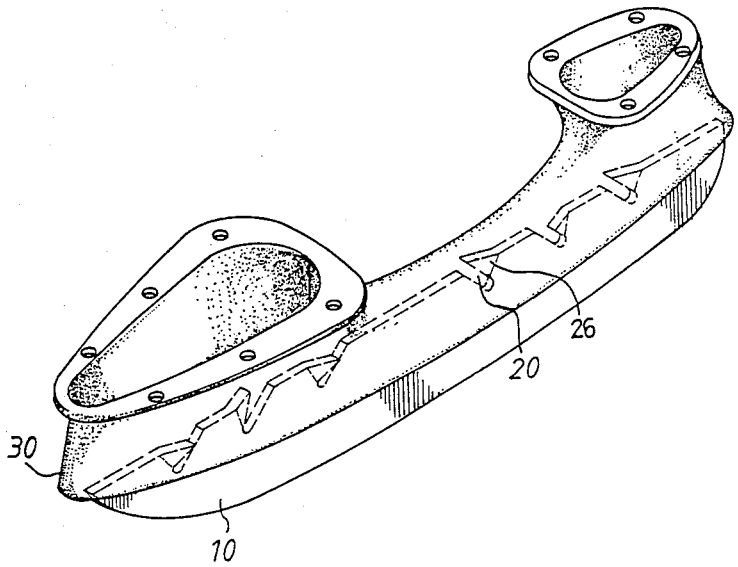
FIG. 2 is another perspective view of the blade together with the plastic material in which the blade is embedded.
Figure 3:
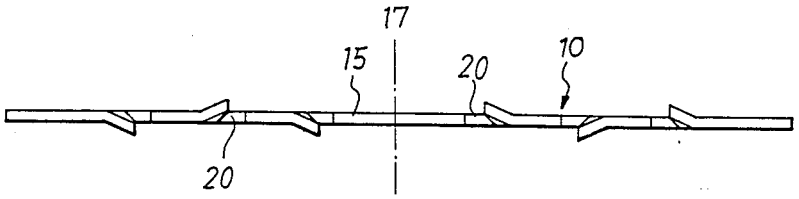
FIG. 3 is a top view of the blade shown in FIG. 1.
Figure 4:
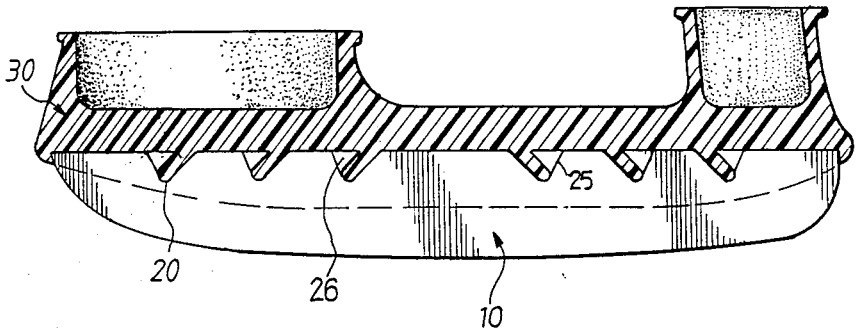
FIG. 4 is a cross-sectional view of a stake comprising the blade according to the invention.
Figure 5:
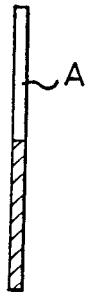
PRIOR ART FIG. 5
FIG. 5 is a cross-sectional view of a prior art blade.
Figure 6:
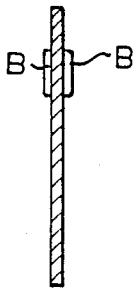
PRIOR ART FIG. 6
FIG. 6 is a cross-sectional view of the blade of another prior art.
Figure 7:
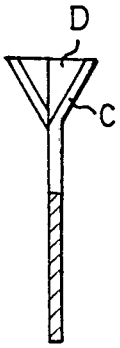
FIG. 7 is a cross-sectional view of the blade shown in FIG. 4 taken from line 7—7 with the plastic material detached.
Figure 8:
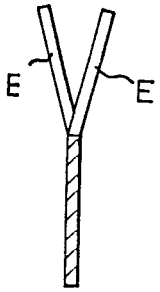
PRIOR ART FIG. 8
FIG. 8 is a cross-sectional view of the blade of still another prior art.

Referring to FIG. 1, it can be seen that a blade (10) according to the invention comprises a plurality of slanted slots or cut-outs (20) near the top edge (15) thereof. The slots (20) are symmetrically arranged on the top edge (15) of the blade (10) with the slot openings toward the center line (17) of the blade (10). A plurality of remaining materials are hence formed between two adjacent slanted slots (20), and between either of the front and rear ends of the blade (10) and the slanted slot (20) adjacent to the end. A tip portion of each of the remaining materials, which faces towards the center line (17) of the blade (10), is laterally bent alternatively leftward or rightward about a non-horizontal axis (25) on the remaining material. The axes (25) are preferably substantially vertical or at only a slight angle to the vertical. A plurality of oblique triangles (26) are thus formed and same number of end areas or surfaces (D) can be viewed (see FIG. 7) from either end of the blade (10). This provides multi-directional contact surfaces between the blade (10) and the plastic material (30) (FIGS. 2 and 4). The sum of areas (D and C) is obviously larger than the area (A) shown in FIG. 5 or the area (E) shown in FIG. 8. The procedure for creating additional end surface area according to this invention is easier than that seen in Florjancic and the effect (e.g. larger end surfaces) thus produced in this invention is also significantly better than that in Florjancic. It is noted that in FIG. 8, although the remaining material between two adjacent slots of a blade are alternatively bent laterally, no end surface is created (the end surface is what can be viewed from either end of the blade) because the bend is made about a horizontal axis. The end surfaces (26), which increase contact surface area on planes normal to the blade (10) between the blade (10) and the plastic material (30), reduce stress and strain therebetween and further avoid possible stress concentration in both the blade (10) and the plastic material (30).

Figure 9:
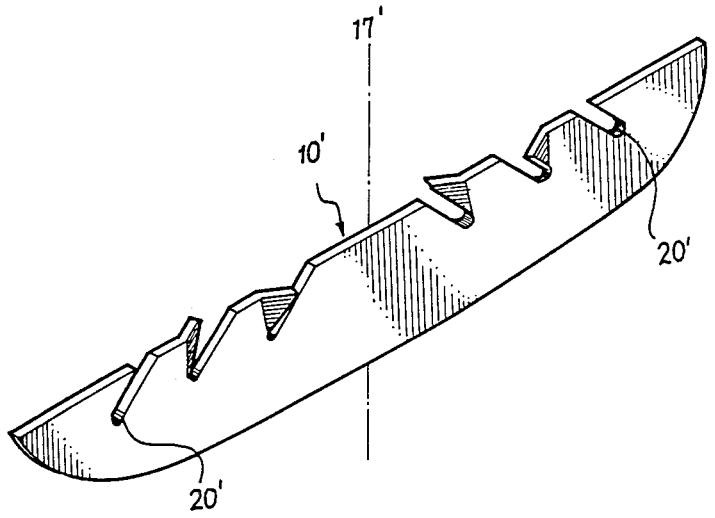
FIG. 9 is a perspective view of the second embodiment of the blade according to this invention.

Referring to FIG. 9, the blade (10') which is the second embodiment according to this invention can be clearly seen. The only difference between the blade (10) described hereinbefore and the blade (10') is that the tip portion of each of the remaining materials between either end of the blade (10') and its adjacent slot (20'), which faces towards the center line (17') of the blade (10'), is not bent. This prevents either end of the plastic material (30) enclosing the upper portion of the blade (10) from being projected outwards by the bent tip portions (26) in the event that either end of the plastic material (30) is not thick enough.

As various possible embodiments might be made of the above invention without departing from the scope of the invention, it is to be understood that all matter herein described or shown in the accompanying drawings is to be interpreted as illustrative and not in a limiting sense. Thus it will be appreciated that the drawings are exemplary of a preferred embodiment of the invention, the scope of the invention is intended to be limited only by the scope of the appended claims.

I claim:

1. In a blade for ice hockey skates comprising: a plurality of slanted slots which are symmetrically provided on a top edge of said blade, each opening of said slots facing upward and toward a center line of said blade; and a plurality of remaining materials between two adjacent said slanted slots:

the improvements in that: a tip portion of each of said remaining materials, which faces towards said center line of said blade, is bent alternatively leftward and rightward about a non-horizontal axis on said remaining material.

2. In a blade as claimed in claim 1, wherein said blade further comprises remaining materials between either end of said blade and the slanted slot adjacent to said end.

3. In a blade as claimed in claim 2, wherein said non-horizontal axis is substantially vertical or at a slight angle to the vertical.

* * * * *